US011721535B2

(12) United States Patent
Kubo

(10) Patent No.: US 11,721,535 B2
(45) Date of Patent: Aug. 8, 2023

(54) APPARATUS AND METHOD FOR PROCESSING MASS SPECTRUM

(71) Applicant: JEOL Ltd., Tokyo (JP)

(72) Inventor: Ayumi Kubo, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 17/509,381

(22) Filed: Oct. 25, 2021

(65) Prior Publication Data

US 2022/0130653 A1 Apr. 28, 2022

(30) Foreign Application Priority Data

Oct. 26, 2020 (JP) ..... 2020-178618

(51) Int. Cl.
*H01J 49/00* (2006.01)
*H01J 49/16* (2006.01)

(52) U.S. Cl.
CPC ..... *H01J 49/0036* (2013.01); *H01J 49/164* (2013.01)

(58) Field of Classification Search
CPC ..... H01J 49/0036; H01J 49/164
USPC ..... 250/281, 282
See application file for complete search history.

(56) References Cited

U.S. PATENT DOCUMENTS

2005/0230611 A1* 10/2005 Denny ..... H01J 49/0036 250/282
2009/0294645 A1 12/2009 Gorenstein et al.
2010/0072356 A1* 3/2010 Ivosev ..... H01J 49/0036 250/252.1
2013/0087701 A1* 4/2013 Ivosev ..... H01J 49/0036 250/281
2013/0119248 A1 5/2013 Bowdler
2013/0311110 A1 11/2013 Aizikov et al.
2014/0166877 A1 6/2014 Green et al.
2019/0172695 A1* 6/2019 Nagatomo ..... G01N 30/72

FOREIGN PATENT DOCUMENTS

| | | | |
|---|---|---|---|
| GB | 2409568 | A | 6/2005 |
| JP | 2004519665 | A | 7/2004 |
| JP | 2005201899 | A | 7/2005 |
| JP | 2009539067 | A | 11/2009 |
| JP | 2010518362 | A | 5/2010 |
| JP | 2012528317 | A | 11/2012 |
| JP | 2013534311 | A | 9/2013 |
| JP | 2015523549 | A | 8/2015 |
| JP | 201661670 | A | 5/2016 |
| WO | 02066952 | A2 | 8/2002 |
| WO | 2009110026 | A1 | 11/2009 |

OTHER PUBLICATIONS

Extended European Search Report issued in EP21203250.2 dated Apr. 4, 2022.
Office Action issued in JP2020178618 dated Sep. 27, 2022.

* cited by examiner

*Primary Examiner* — Michael Maskell
(74) *Attorney, Agent, or Firm* — The Webb Law Firm

(57) ABSTRACT

An extraction section extracts a basic pattern of chemical noise included in a mass spectrum. A generation section generates pseudo chemical noise as a connected body of a plurality of pseudo fragments generated by intensity correction of the basic pattern. A removal section removes the pseudo chemical noise from the mass spectrum.

10 Claims, 14 Drawing Sheets

APPARATUS AND METHOD FOR PROCESSING MASS SPECTRUM

CROSS REFERENCE TO RELATED APPLICATION

This application claims priority to Japanese Patent Application No. 2020-178618 filed Oct. 26, 2020, the disclosure of which is hereby incorporated by reference in its entirety.

BACKGROUND OF THE INVENTION

Field of the Invention

The present disclosure relates to an apparatus and method for processing a mass spectrum, and in particular to removing certain noise components included in the mass spectrum.

Description of Related Art

A mass spectrometry system is generally composed of a mass spectrometry apparatus and a mass spectrum processing apparatus. The mass spectrum processing apparatus processes a mass spectrum generated by performing mass spectrometry on a sample.

The mass spectrum sometimes includes a noise component with periodicity along the mass axis (m/z axis). Such a noise component tends to occur, for example, when an ion source according to the Matrix Assisted Laser Desorption/Ionization (MALDI) method is used as an ion source. It is understood that a noise component with periodicity is generally derived not from electrical noise but from a substance other than an object to be observed (typically, an impurity in the sample). From this point of view, a noise component with periodicity is generally referred to as chemical noise. Also in the present specification, it will be referred to as chemical noise.

Chemical noise is composed of a plurality of repeating units connected along the mass axis (m/z axis). Although the width of the repeating unit; that is, the mass pitch of chemical noise, is typically a value around 1 u, the mass pitch depends on a substance that causes the chemical noise. Noticeable chemical noise occurs particularly on the low mass side in a mass spectrum.

JP 2005-201899 A discloses a technique of removing chemical noise from a mass spectrum. In this technique, the inside of a target window corresponding to the repeating unit is divided into a plurality of channels, and a background component is removed for each channel. The target window has a fixed width. The intensity of the background component is computed from an intensity histogram generated by referring to eight channels discretely distributed before and after the target window, and the resulting intensity is generally an average intensity. The technique disclosed in JP 2005-201899 A does not extract a basic form of chemical noise to use it to remove chemical noise. JP 2004-519665 A discloses chemical noise in FIG. 2. However, it nowhere discloses a technique of removing the chemical noise.

Prior to observation, analysis, etc. of a mass spectrum, chemical noise included in the mass spectrum needs to be removed. In this regard, a waveform fitting method can be used to estimate baseline components in the mass spectrum to subtract the baseline components from the mass spectrum. However, generally, such a method can only suppress noise with a large period of 100 u or more and cannot remove chemical noise sufficiently.

SUMMARY OF THE INVENTION

An object of the present disclosure is to effectively remove chemical noise included in a mass spectrum using periodicity the chemical noise has. Alternatively, an object of the present disclosure is to provide a chemical noise removal technique that facilitates storage of true peaks.

A mass spectrum processing apparatus according to the present disclosure includes an extraction section that extracts a basic pattern of chemical noise included in a mass spectrum, a generation section that generates pseudo chemical noise as a connected body of a plurality of pseudo fragments generated by intensity correction of the basic pattern, and a removal section that removes the pseudo chemical noise from the mass spectrum.

A mass spectrum processing method according to the present disclosure includes the steps of extracting a basic pattern of chemical noise included in a mass spectrum, generating pseudo chemical noise as a connected body of a plurality of pseudo fragments generated by applying intensity correction to the basic pattern, and removing the pseudo chemical noise from the mass spectrum.

BRIEF DESCRIPTION OF THE DRAWINGS

Embodiments of the present disclosure will be described based on the following figures, wherein.

DESCRIPTION OF THE INVENTION

Figure 1:
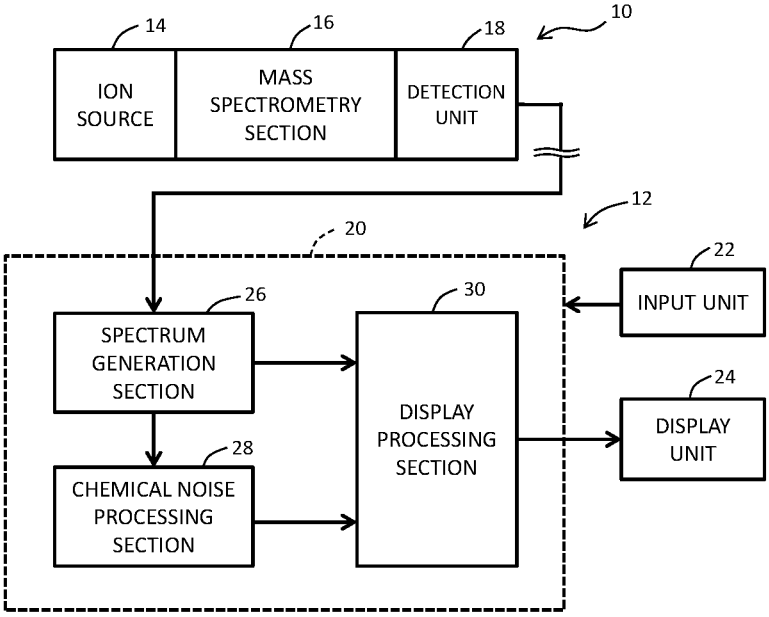
FIG. 1 is a block diagram showing a mass spectrum processing apparatus according to an embodiment.

Hereinafter, embodiments will be described with reference to the drawings.

(1) Summary of Embodiments

A mass spectrum processing apparatus according to an embodiment includes an extraction section, a generation section, and a removal section. The extraction section extracts a basic pattern of chemical noise included in a mass spectrum. The generation section generates pseudo chemical noise as a connected body of a plurality of pseudo fragments generated by intensity correction of the basic pattern. The removal section removes the pseudo chemical noise from the mass spectrum.

With the above configuration, the pseudo chemical noise can be generated on the basis of the basic pattern of the chemical noise, and it is thus possible to enhance the quality of pseudo chemical noise; that is, the accuracy in chemical noise estimation. In other words, it is possible to increase the likelihood of storing true peaks in removing the pseudo chemical noise from the mass spectrum, and remove chemical noise effectively.

Chemical noise has periodicity and is composed of a plurality of repeating units. The individual repeating units have almost the same form. The basic pattern can thus be extracted from all of the plurality of repeating units in the mass spectrum. The basic pattern has a basic form or a common waveform, and it also serves as a template for the pseudo fragments. As a matter of course, when the chemical noise is observed in macro, it is recognized that the intensity of the chemical noise tends to change along the mass axis (the intensity tends to be higher on the low mass side). The basic pattern is extracted such that it is not affected by such changes in intensity. The likelihood of obtaining a better basic pattern can be increased by extracting the basic pattern from the entire chemical noise or most of the chemical noise.

In generating the pseudo chemical noise, two steps; that is, an intensity correction step and a connection step, are performed in the embodiment. One of the steps may be performed prior to the other one, or both of the steps may be performed simultaneously. More specifically, intensity correction may first be applied to the basic pattern to thereby generate a plurality of pseudo fragments. The plurality of pseudo fragments may then be connected. Alternatively, a connected body of a plurality of temporary fragments may first be formed based on the basic pattern, and then, intensity correction may be applied to the plurality of temporary fragments. The pseudo fragment is a concept to be compared with an actual fragment that is cut out from the mass spectrum. The pseudo fragment is a simulated fragment or an artificial fragment obtained after intensity correction. The temporary fragment corresponds to the basic pattern itself and is a fragment obtained before intensity correction.

In the embodiment, the extraction section includes a cut-out unit and a pattern generation section. The cut-out unit cuts out a plurality of actual fragments from the mass spectrum according to the mass pitch of the chemical noise. The pattern generation section generates the basic pattern based on the plurality of actual fragments. By referring to a number of actual fragments across the range where the chemical noise is present, the quality of the basic pattern can be further improved. A plurality of reference ranges may be set for the range where the chemical noise is present, and a basic pattern may be generated for each of the reference ranges.

In the embodiment, the extraction section includes a pitch computation section that obtains the mass pitch by analyzing the mass spectrum. The mass pitch varies depending on a substance that generates the chemical noise, and thus, the pitch computation section determines the mass pitch by actually analyzing the mass spectrum. In the embodiment, the pitch computation section obtains the mass pitch by autocorrelation computation by using a portion of the mass spectrum that is within a chemical noise reference range set for the mass spectrum. The entire mass spectrum may be set as the chemical noise reference range. The repeating unit with a period of the mass pitch is repeated in the chemical noise. The mass pitch is also the mass width of the repeating unit. The mass pitch can also be identified by spatial frequency analysis or the like, in addition to autocorrelation computation.

In the embodiment, the pattern generation section includes a function computation section, a normalization unit, and a computation unit that generates the basic pattern. The function computation section computes an intensity function based on the plurality of actual fragments. The normalization unit normalizes the plurality of actual fragments based on the intensity function. The computation unit generates the basic pattern based on the plurality of actual fragments obtained after normalization. Normalization allows the intensities of the plurality of actual fragments to coincide with one another. The basic pattern can be generated by integrating or averaging the plurality of actual fragments obtained after normalization.

In the embodiment, the generation section includes a correction unit and a connection unit. The correction unit applies intensity correction to the basic pattern based on the intensity function obtained from the mass spectrum, thereby generating the plurality of pseudo fragments. The connection unit connects the plurality of pseudo fragments, thereby forming the pseudo chemical noise. Alternatively, the connection unit forms a connected body of a plurality of temporary fragments based on the basic pattern. The correction unit applies intensity correction to the plurality of temporary fragments based on the intensity function obtained from the mass spectrum, thereby generating, as the connected body of the plurality of pseudo fragments, the pseudo chemical noise.

The mass spectrum processing apparatus according to the embodiment includes a display processing section that displays two mass spectra, one mass spectrum obtained before the pseudo chemical noise is removed, and one mass spectrum obtained after the pseudo chemical noise is removed. With this configuration, it is possible to confirm that chemical noise removal processing has been carried out appropriately and visually identify the extent of the effect of chemical noise removal. The display processing section further displays the pseudo chemical noise. This configuration enables visual identification of chemical noise in the mass spectrum. The pseudo chemical noise may be displayed in both a normal view and an enlarged view. It is also possible to compare two pseudo chemical noises between two samples. By doing so, impurities in the samples may be analyzed in quality and quantity.

A mass spectrum processing method according to an embodiment includes an extraction step, a generation step, and a removal step. In the extraction step, a basic pattern of chemical noise included in a mass spectrum is extracted. In the generation step, pseudo chemical noise is generated as a connected body of a plurality of pseudo fragments generated by applying intensity correction to the basic pattern. In the removal step, the pseudo chemical noise is removed from the mass spectrum.

The above mass spectrum processing method is implemented as a hardware or software function. In the case of the latter, a program for executing the mass spectrum processing method is installed in an information processing device via a network or a portable storage medium. The concept of the information processing device contains a computer, a mass spectrum processing apparatus, a mass spectrometry system, and the like. The information processing device has a non-transitory storage medium storing the above program.

(2) Details of Embodiments

FIG. 1 shows a mass spectrometry system according to an embodiment. This mass spectrometry system performs mass spectrometry on a sample and processes the resulting mass spectrum. The mass spectrometry system is composed of a mass spectrometry apparatus 10 and an information processing device 12.

The mass spectrometry apparatus 10 has an ion source 14, a mass spectrometry section 16, and a detection unit 18. The ion source 14 ionizes the sample to thereby generate ions. The generated ions are carried to the mass spectrometry section 16. The ion source 14 is, for example, an ion source according to the Matrix Assisted Laser Desorption/Ionization (MALDI) method. Ion sources according to other ionization methods may also be used.

The mass spectrometry section 16 performs mass spectrometry on the individual ions based on mass-to-charge ratios (m/z) of the ions. A time-of-flight mass spectrometer, a quadrupole mass spectrometer, or the like may be used as the mass spectrometry section 16. The ions that have passed through the mass spectrometry section 16 are detected by the detection unit 18. The detection unit 18 may be incorporated in the mass spectrometry section 16.

The detection unit 18 outputs an analog detection signal indicating the amount of ions for each mass-to-charge ratio. The analog detection signal is converted to a digital detection signal by a signal processing circuit (not shown). The digital detection signal is transmitted to the information processing device 12.

The information processing device 12 is composed of a computer. The information processing device 12 has a processor 20, an input unit 22, and a display unit 24. The information processing device 12 may control the operation of the mass spectrometry apparatus 10. The processor 20 is, for example, composed of a CPU for executing a program.

In FIG. 1, a plurality of functions to be executed by the processor 20 are expressed by a plurality of blocks. The processor 20 functions as a spectrum generation section 26, a chemical noise processing section 28, and a display processing section 30. The input unit 22 is composed of a keyboard, a pointing device, or the like. The display unit 24 is composed of an LCD or the like.

The spectrum generation section 26 generates a mass spectrum based on the digital detection signal. The spectrum generation section 26 may be provided in the mass spectrometry apparatus 10. Data indicating the generated mass spectrum are transmitted to the chemical noise processing section 28 and the display processing section 30.

The chemical noise processing section 28 removes a noise component with periodicity included in the mass spectrum; that is, chemical noise. Data indicating the mass spectrum obtained after removal of the chemical noise are transmitted to the display processing section 30.

The display processing section 30 has an image synthesizing function, an image enlarging function, a color computing function, and the like. The display processing section 30 forms an image to be displayed on the display unit. The image may include the mass spectrum obtained before removal of the chemical noise, the mass spectrum obtained after removal of the chemical noise, pseudo chemical noise, and the like. The user uses the input unit 22 to specify a reference range in the mass spectrum, a chemical noise removal range, and various other parameters.

Figure 2:
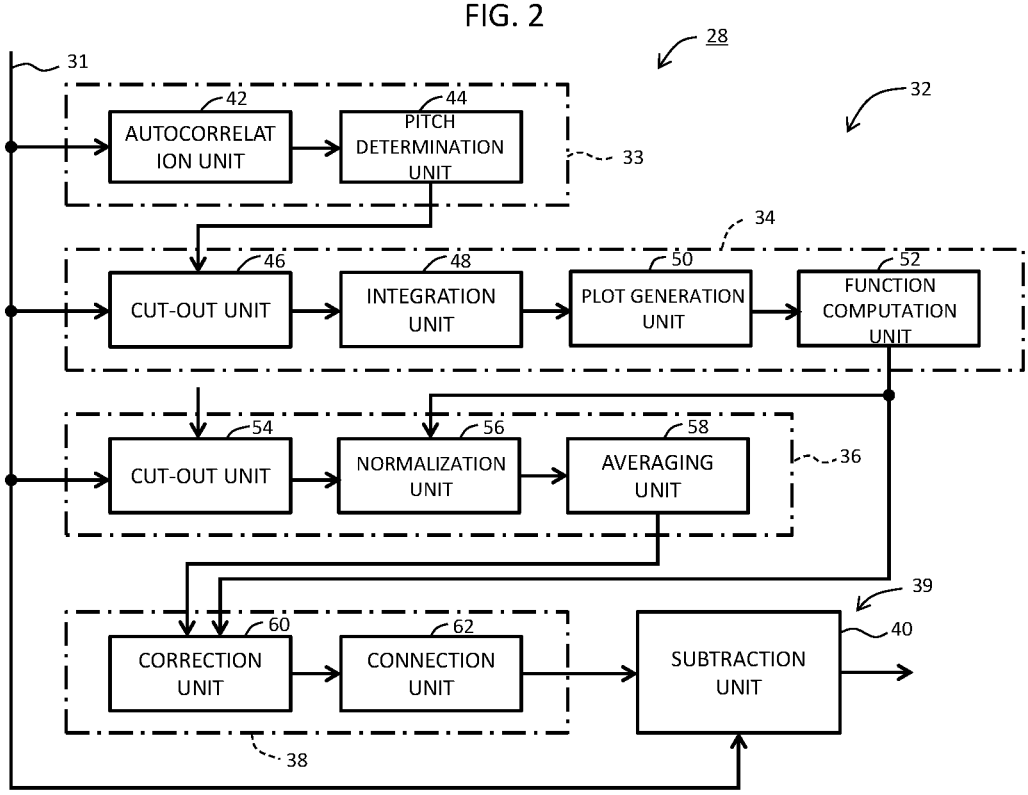
FIG. 2 is a block diagram showing an example configuration of a chemical noise processing section.

In FIG. 2, the plurality of functions of the chemical noise processing section 28 in FIG. 1 are expressed by a plurality of blocks. FIG. 2 shows an algorithm or a plurality of steps executed in a mass spectrum processing method according to an embodiment.

The chemical noise processing section 28 has an extraction section 32, a generation section 38, and a removal section 39. Chemical noise is composed of a plurality of repeating units aligned along the mass axis (m/z axis). The extraction section 32 extracts a basic pattern from all of the plurality of repeating units. The extraction section 32 has a mass pitch computation section 33, an intensity function computation section 34, and a basic pattern generation section 36.

The user sets the reference range in a mass spectrum 31. A portion of the mass spectrum that is within the reference range is transmitted to the mass pitch computation section 33, the intensity function computation section 34, and the basic pattern generation section 36. The reference range is set, for example, so as to cover, in the mass spectrum 31, a range in which the chemical noise is present or to cover most of that range. When the chemical noise is observed in macro, the range in which the chemical noise is present can be defined as a range from the mass end (minimum mass) on the low mass side of the mass spectrum 31 to a level at which the intensity of the chemical noise substantially reaches a noise level near the baseline. Within the range in which the chemical noise is present, the reference range may be defined as a range within 70% to 80% or more from the mass end on the low mass side. As a matter of course, the entire mass spectrum 31 may be defined as the reference range. The reference range will be described in detail below with reference to FIG. 4.

The mass pitch computation section 33 has an autocorrelation unit 42 and a pitch determination unit 44. The autocorrelation unit 42 computes autocorrelation coefficients between the portion of the mass spectrum that is within the reference range and a portion obtained by shifting that portion of the mass spectrum in the mass axis direction. A plurality of autocorrelation coefficients are computed by changing the amount of shift in a stepwise manner. The range of the amount of shift is between 0.5 u and 2.5 u, for example. The pitch of the amount of shift is 0.005 u, for example. A distribution of autocorrelation coefficients is thus generated. The pitch determination unit 44 determines the mass pitch based on the distribution of autocorrelation coefficients. A specific example thereof will be described in detail below with reference to FIG. 5. The mass pitch is typically a value within a range around 1 u. The mass pitch may vary depending on a substance that generates the chemical noise. Measuring and computing the mass pitch can enhance the effect of chemical noise removal.

Information for specifying the mass pitch is transmitted from the pitch determination unit 44 to cut-out units 46 and 54. The cut-out units 46 and 54 have substantially the same function, and they are actually composed of a single cut-out unit. In FIG. 2, the two cut-out units 46 and 54 are explicitly shown for easy understanding of the relations among the plurality of functions.

The intensity function computation section 34 has the cut-out unit 46, an integration unit 48, a plot generation unit 50, and a function computation unit 52. The cut-out unit 46 cuts out the portion of the mass spectrum that is within the reference range for each mass pitch, to thereby generate a plurality of actual fragments. The integration unit 48 sums; that is, integrates, the individual actual fragments, thereby obtaining an integrated value. A plurality of integrated values from the minimum mass value to the maximum mass value in the reference range are obtained.

The plot generation unit 50 arranges a plurality of points indicating the plurality of integrated values on the two-dimensional coordinate formed by the mass axis and the integrated value axis, thereby generating a plot of integrated values. The function computation unit 52 computes an intensity function as a function for approximating the plot of integrated values. Based on the intensity function, the intensity corresponding to each m/z is obtained as a normalization value and an intensity correction value. Data indicating the intensity function are transmitted to the basic pattern generation section 36 and the pseudo chemical noise generation section 38.

The basic pattern generation section 36 has the cut-out unit 54, a normalization unit 56, and an averaging unit 58. The cut-out unit 54 has the same function as the above cut-out unit 46. That is, the cut-out unit 54 sequentially cuts out actual fragments having a width corresponding to the mass pitch, from the portion of the mass spectrum that is within the reference range. A number of actual fragments are thus generated.

The normalization unit 56 divides each actual fragment by the intensity identified from the intensity function (normalization value), thereby normalizing each actual fragment. Normalization of the plurality of actual fragments can be recognized as processing of aligning the amplitudes of those fragments. It is also possible to perform other normalization processing that adjusts maximum values of the individual actual fragments to 100% without using the intensity function. The averaging unit 58 is a computation unit that generates a basic pattern by integrating or averaging the plurality of actual fragments obtained after normalization. The basic pattern is a basic form or a common pattern of the plurality of actual fragments. The scale of the vertical axis for the basic pattern may be defined as desired. In this sense, integrating the plurality of actual fragments obtained after normalization can be regarded as the same as averaging the plurality of actual fragments obtained after normalization. Data indicating the generated basic pattern is transmitted to the generation section 38. The basic pattern can also be referred to as a master fragment. The basic pattern may be generated using a method other than integration or averaging.

The generation section 38 is composed of a correction unit 60 and a connection unit 62. The order of arrangement of the units may be reversed. In the embodiment, the correction unit 60 multiplies the basic pattern by a plurality of intensity correction values obtained from the intensity function, thereby generating a plurality of pseudo fragments. The connection unit 62 connects the plurality of pseudo fragments in the order of their arrangement, thereby forming pseudo chemical noise. The pseudo chemical noise may also be referred to as an artificially generated chemical noise model.

In the generation section 38, it is also possible to first connect a plurality of basic patterns as a plurality of temporary fragments and then apply intensity correction to each temporary fragment. Even in that case, pseudo chemical noise similar to that described above may be generated.

In the embodiment, the removal section 39 is composed of a subtraction unit 40. The subtraction unit 40 subtracts the pseudo chemical noise generated as described above from the mass spectrum 31. Thus, a mass spectrum from which the chemical noise has been removed can be obtained. Data indicating the resulting mass spectrum are transmitted to the display processing section.

Hereinafter, each processing described above will be specifically described.

Figure 3:
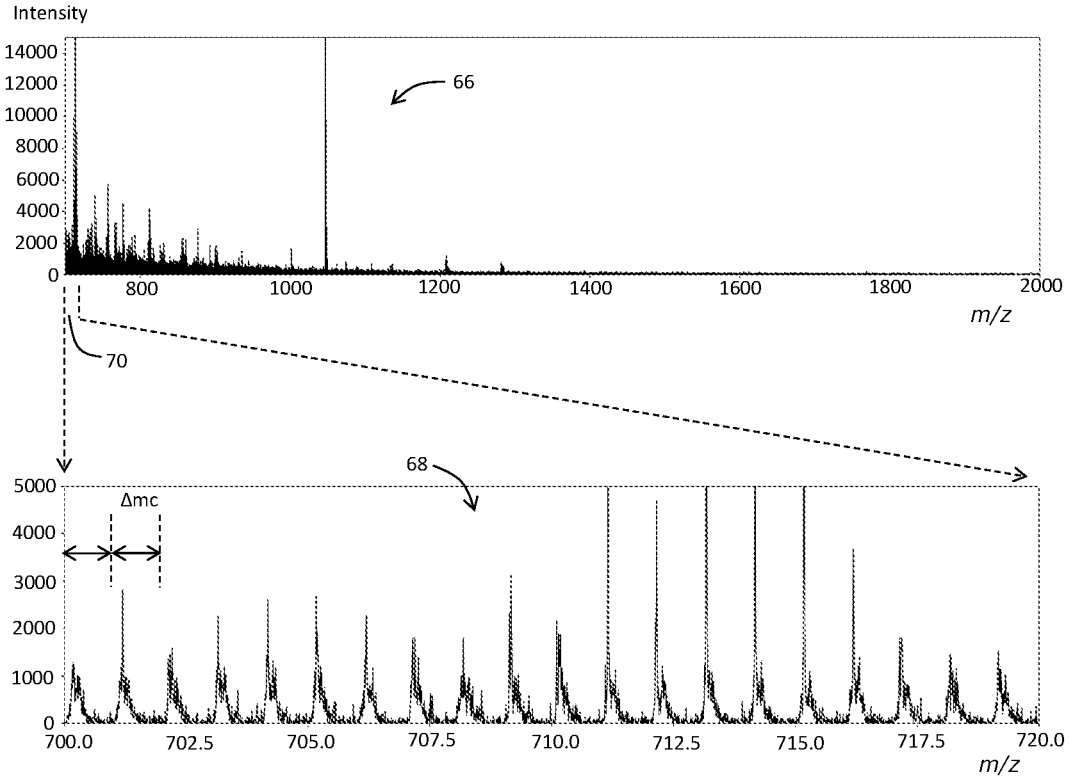
FIG. 3 is a diagram showing an example of a mass spectrum containing chemical noise.

The upper part of FIG. 3 shows a mass spectrum 66 obtained before chemical noise is removed. The lower part of FIG. 3 shows an enlarged view 68 of a portion 70 of the mass spectrum 66. The mass width of a repeating unit is indicated by Δmc.

Figure 4:
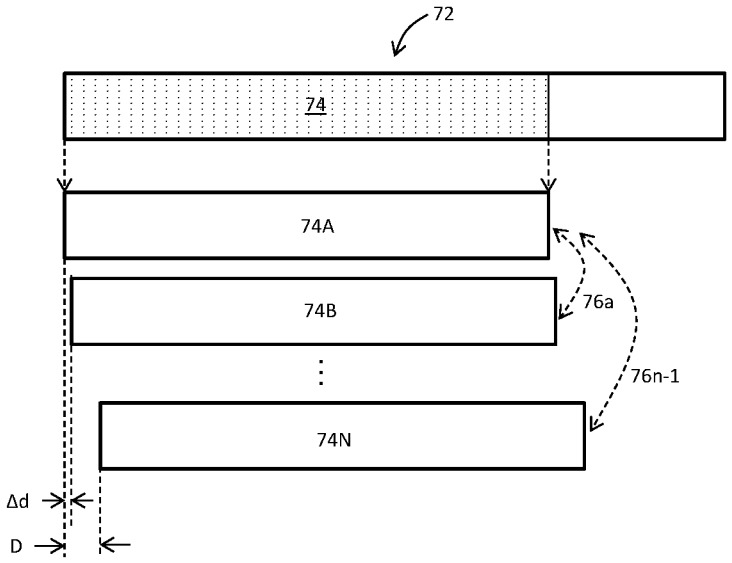
FIG. 4 is a diagram for explaining computation of autocorrelation coefficients based on a mass spectrum.

FIG. 4 shows a reference range 74 set for a mass spectrum 72 before chemical noise is removed. In the mass spectrum 72, the reference range 74 may be defined as a range that covers substantially the entire chemical noise from the mass end on the low mass side. In this case, the reference range 74 may be defined by the user or may be defined automatically.

A portion 74A of the mass spectrum in the reference range 74 is used as a template for autocorrelation computation. A plurality of autocorrelation coefficients are computed (see reference numerals 76*a*, . . . , 76*n*-1) between the template 74A and a plurality of portions of the mass spectrum 74B, . . . , 74N that are shifted from the template 74A in the mass axis direction in a stepwise manner and have the same content as the template 74A. The upper limit of the shift range is indicated by D, and the shift pitch is indicated by Δd.

Figure 5:
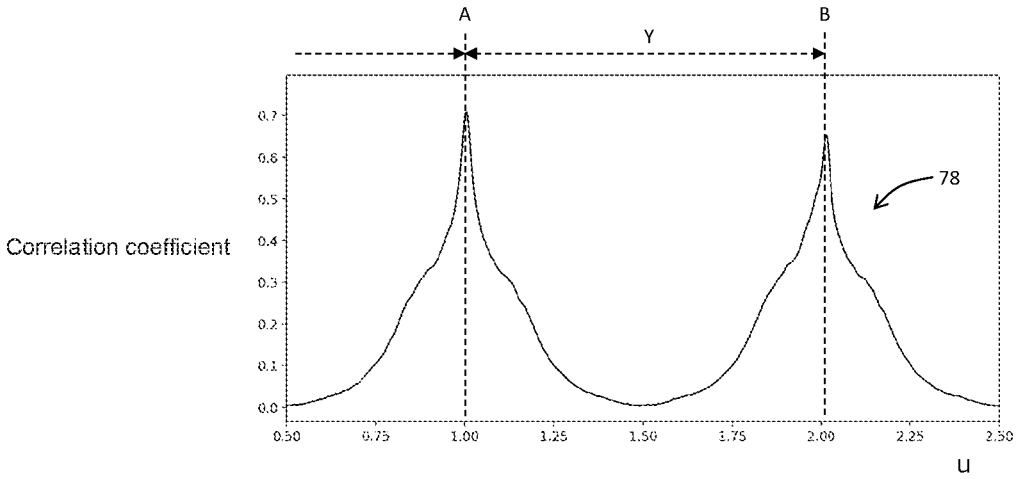
FIG. 5 is a diagram showing a distribution of autocorrelation coefficients.

FIG. 5 shows an autocorrelation coefficient distribution 78. The horizontal axis indicates the amount of shift. Its unit is u. The vertical axis indicates the size of an autocorrelation coefficient. In the illustrated example, the distribution 78 has two peaks A and B. For example, the mass identified by A is regarded as the mass pitch. An interval Y between the two peaks A and B may be regarded as the mass pitch. A threshold may be provided for the autocorrelation coefficients, and portions that are greater than or equal to the threshold in the distribution 78 may be used as a reference. For example, the mass pitch may be identified at the time when a portion that is greater than or equal to the threshold occurs. If more than one portion greater than or equal to the threshold occurs, a point having the highest autocorrelation coefficient may be identified among the portions to determine the mass pitch. If there is no portion greater than or equal to the threshold, the processing may end.

The mass pitch may be identified by a method other than the method using autocorrelation. For example, a basic period in the horizontal direction may be identified by spatial frequency analysis. The mass pitch may be computed by other methods. By actually measuring the mass pitch, it is possible to improve the quality of the basic pattern and thus to further enhance the effect of chemical noise removal.

Figure 6:
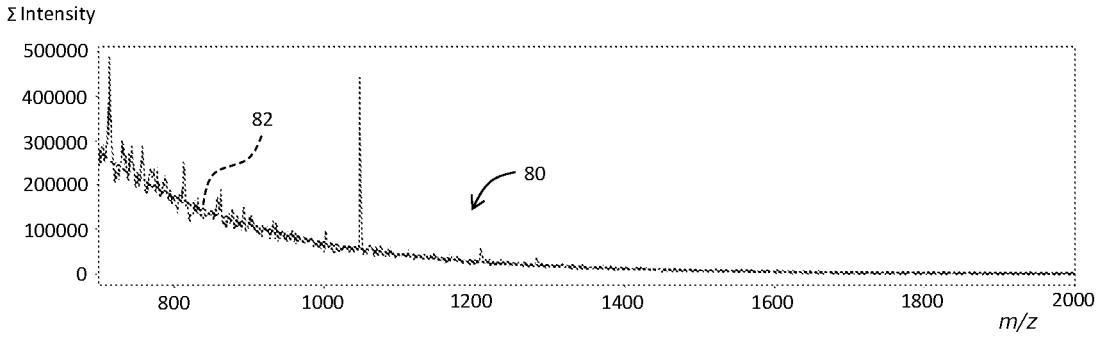
FIG. 6 is a diagram showing changes in intensity integration value.

FIG. 6 shows a plot 80 generated by mapping a plurality of integrated values. A function 82 approximating the plot 80 is identified based on the plot 80, and the function 82 is used as an intensity function. The function 82 is, for example, an exponential function. To identify the function 82, the least squares method or the like may be used. Each integrated value corresponds to the area of each fragment.

Figure 7:
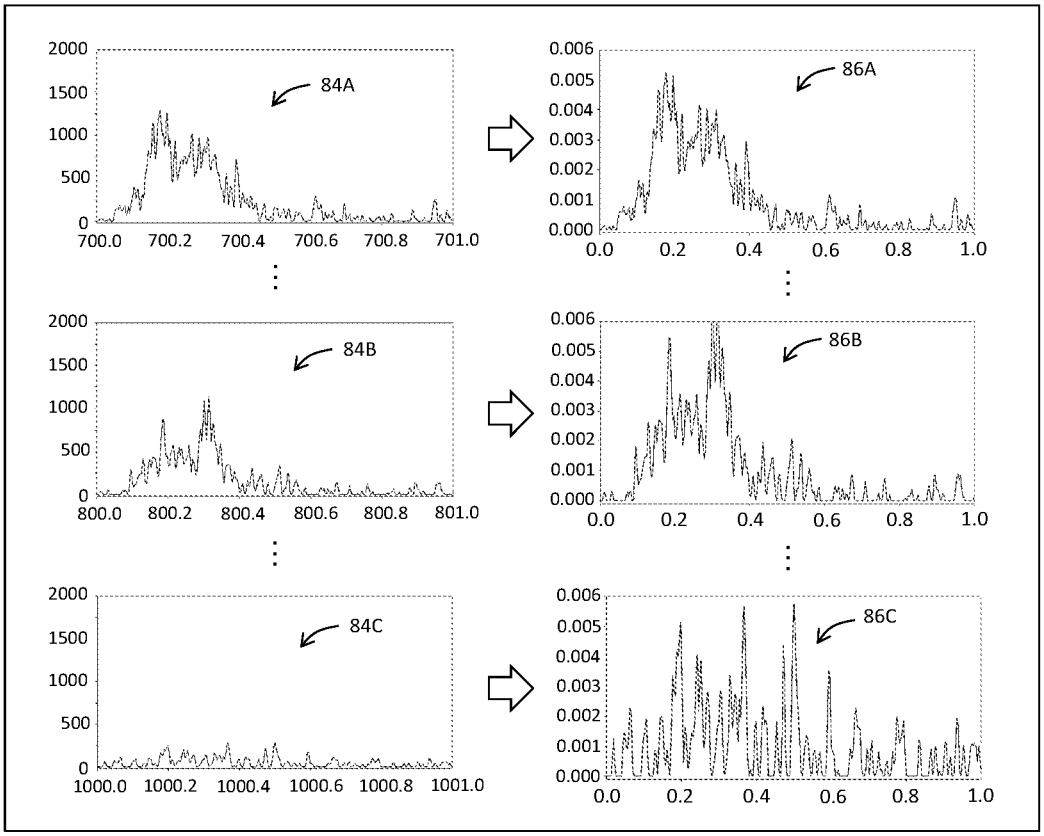
FIG. 7 is a diagram showing normalization of a plurality of actual fragments.

The left side of FIG. 7 shows actual fragments 84A, 84B, and 84C that are part of a plurality of actual fragments, each cut out for each mass pitch. The plurality of actual fragments are subjected to normalization. That is, each actual fragment is divided by the intensity defined by the intensity function. The right side of FIG. 7 shows actual fragments 86A, 86B, and 86C that are part of a plurality of actual fragments obtained after normalization. Based on the intensity function, the intensity corresponding to the center of mass in each actual fragment may be identified as a normalization value.

Figure 8:
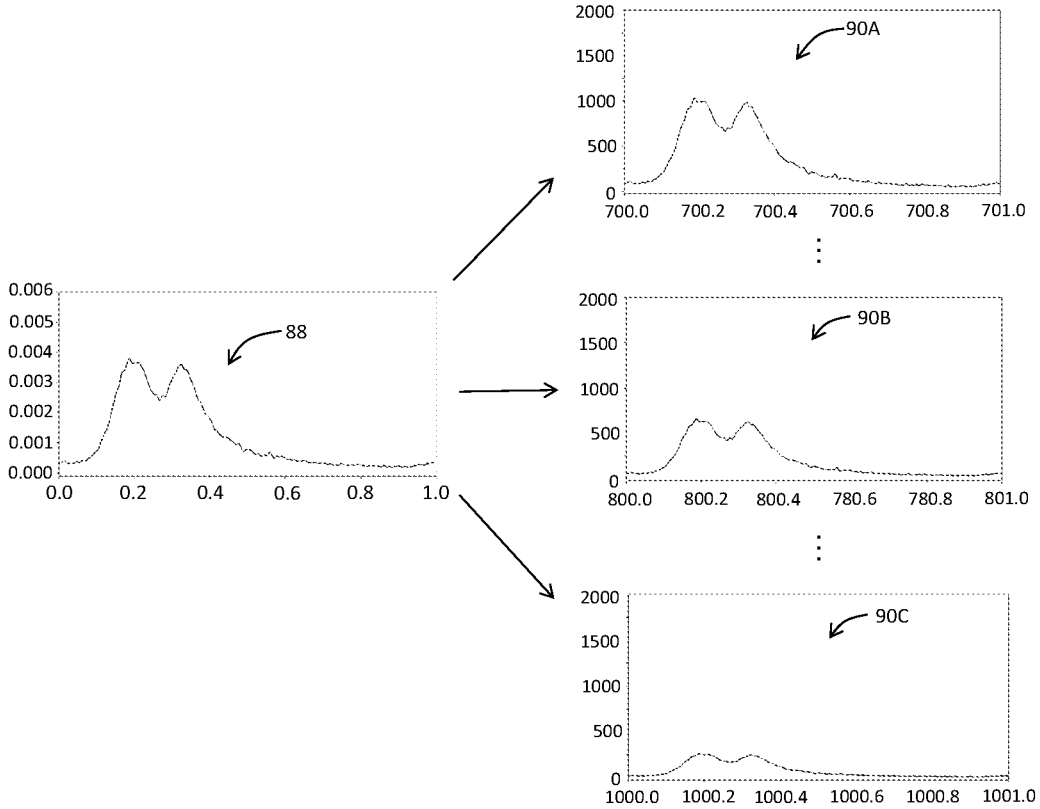
FIG. 8 is diagram showing a plurality of intensity-corrected pseudo fragments generated from a basic pattern.

The left side of FIG. 8 shows a basic pattern 88. The basic pattern 88 is generated, for example, by averaging a plurality of actual fragments obtained after normalization. The basic pattern 88 may also be generated using a method other than averaging (or integration). For example, it is possible to adopt computation of the center of gravity in the vertical axis direction or median extraction. Pre-processing may be applied to each actual fragment prior to generation of the basic pattern 88. Post-processing may be applied to the basic pattern 88 after it is generated. Examples of the pre-processing and the post-processing include smoothing, edge enhancement, and the like.

The right side of FIG. 8 shows pseudo fragments 90A, 90B, and 90C that are part of a plurality of amplitude-corrected pseudo fragments generated based on the basic pattern. In correcting the amplitude, the intensity identified using an amplitude function is used as an intensity correction value. Based on the intensity function, the intensity corresponding to the center of mass in each pseudo fragment may be identified as the intensity correction value. The plurality of amplitude-corrected pseudo fragments arranged along the mass axis are connected in the order of their arrangement, thereby forming pseudo chemical noise. As already described above, it is also possible to first connect a plurality of temporary fragments and then apply mass correction to the temporary fragments individually, thereby forming pseudo chemical noise as a connected body of a plurality of pseudo fragments.

Figure 9:
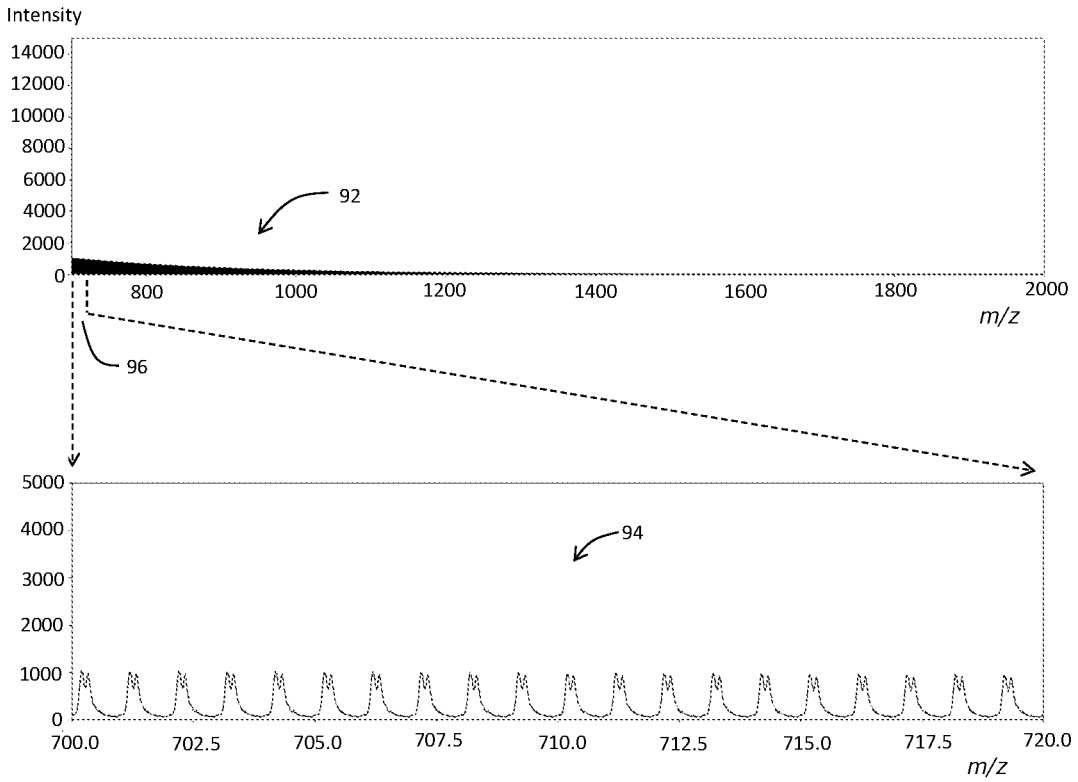
FIG. 9 is a diagram showing an example of estimated chemical noise.

The upper part of FIG. 9 shows pseudo chemical noise 92. The lower part of FIG. 9 shows an enlarged view 94 of a portion 96 of the pseudo chemical noise 92.

Figure 10:
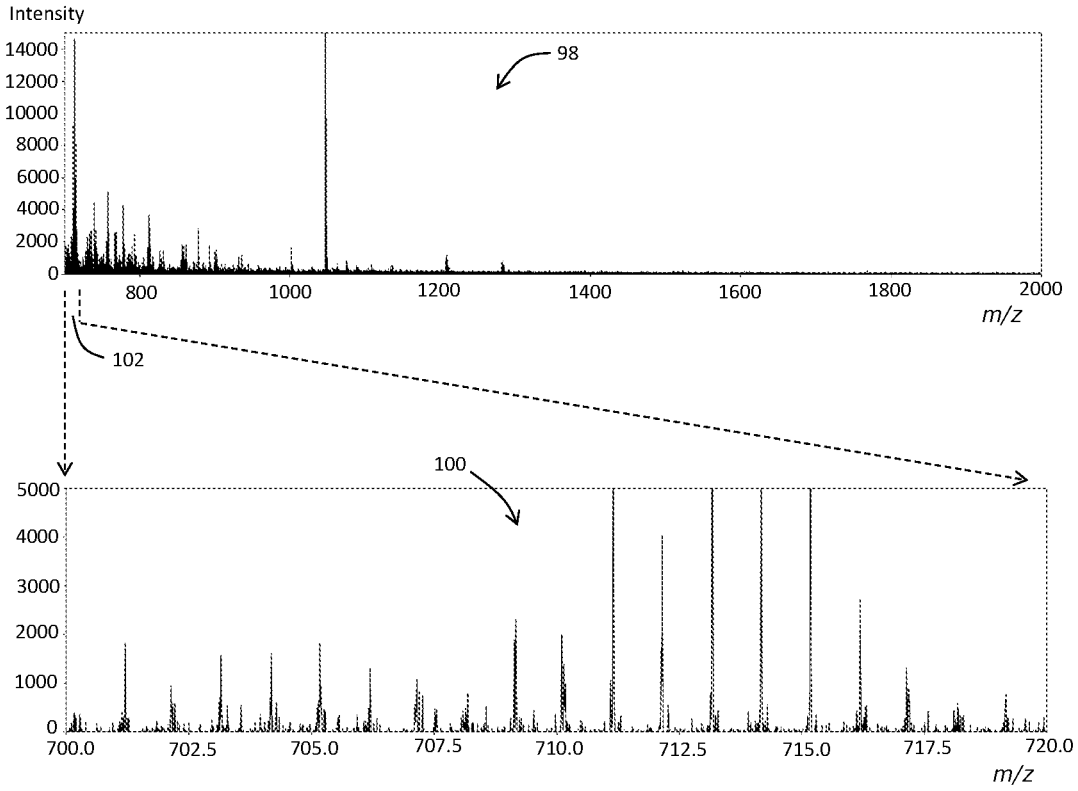
FIG. 10 is a diagram showing an example of a mass spectrum after chemical noise is removed.

The upper part of FIG. 10 shows a mass spectrum 98 obtained after chemical noise is removed. The lower part of FIG. 10 shows an enlarged view 100 of a portion 102 of the mass spectrum 98. As shown, the chemical noise is removed effectively. As a result, a number of true peaks are clearly shown. In particular, true peaks with a low intensity are clearly shown.

Figure 11:
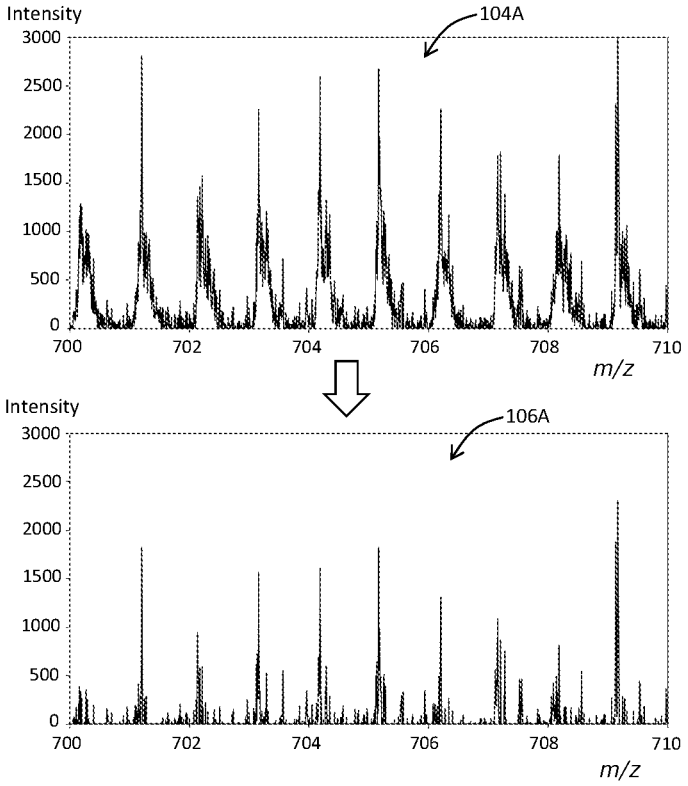
FIG. 11 is an enlarged diagram showing a first portion of a mass spectrum.
Figure 12:
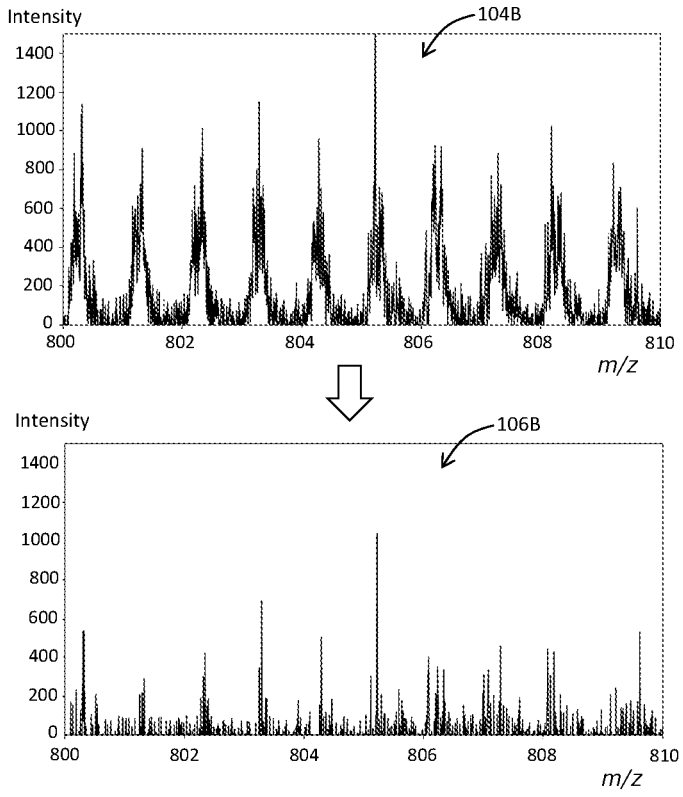
FIG. 12 is an enlarged diagram showing a second portion of the mass spectrum.
Figure 13:
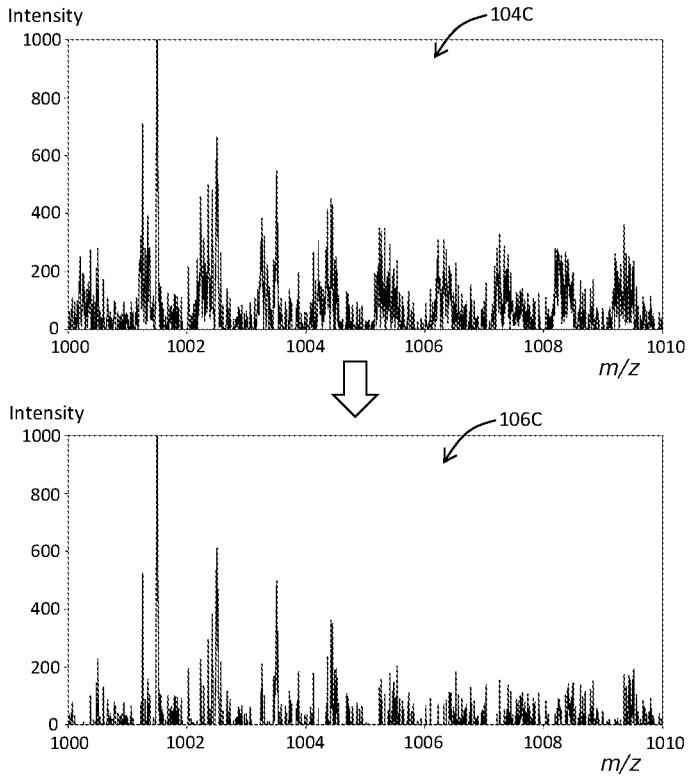
FIG. 13 is an enlarged diagram showing a third portion of the mass spectrum.

FIGS. 11 to 13 show portions of a mass spectrum obtained before and after the chemical noise is removed. The upper parts of the figures show portions 104A, 104B, and 104C of a mass spectrum obtained before chemical noise is removed, and the lower parts of the figures show portions 106A, 106B, and 106C of a mass spectrum obtained after the chemical noise is removed.

Figure 14:
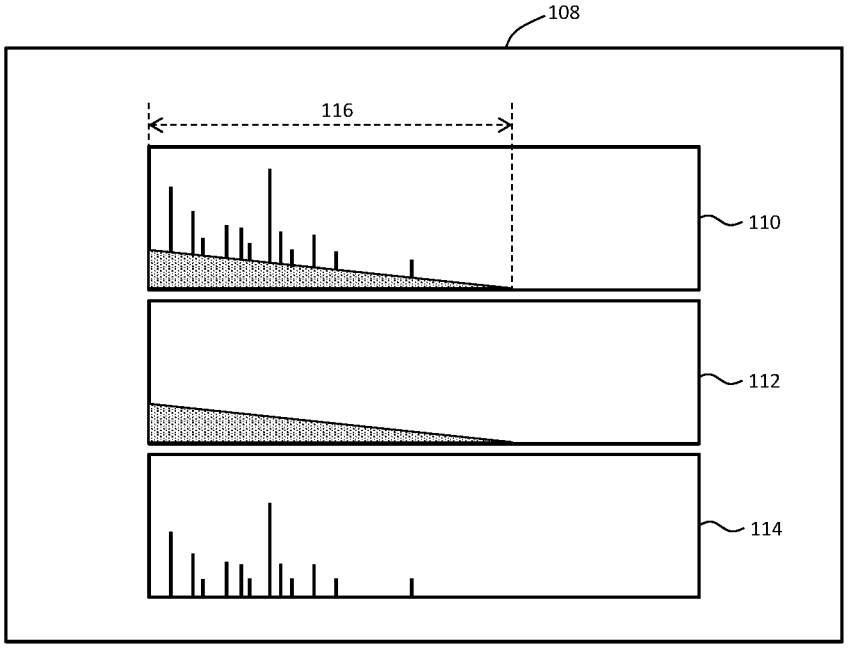
FIG. 14 is a diagram showing an example display.

FIG. 14 shows a display example. A displayed image 108 includes an original mass spectrum 110, pseudo chemical noise 112, and a mass spectrum 114 obtained after chemical noise is removed. In the illustrated example, three mass axes are parallel, and their scales are identical. The scales of three intensity axes are also identical. Reference numeral 116 indicates a range of chemical noise.

The chemical noise may be expressed in colors, and the resulting image may be superimposed on the original mass spectrum 110 displayed in a gray-scale.

According to the embodiments described above, chemical noise included in a mass spectrum can be removed effectively using periodicity the chemical noise has.

The invention claimed is:

1. A mass spectrum processing apparatus comprising:

an extraction section that extracts a basic pattern of chemical noise with periodicity included in a mass spectrum, the basic pattern being a common waveform in a plurality of repeating units constituting the chemical noise, the basic pattern having a mass width of around 1 u;

a generation section that generates pseudo chemical noise as a connected body of a plurality of pseudo fragments generated by intensity correction of the basic pattern; and a removal section that removes the pseudo chemical noise from the mass spectrum, wherein the extraction section comprises:

a cut-out unit that cuts out a plurality of actual fragments, corresponding to the plurality of repeating units, from the mass spectrum according to a mass pitch which is the mass width, and a pattern generation section that generates the basic pattern based on the plurality of actual fragments.

2. The mass spectrum processing apparatus according to claim 1, wherein the extraction section comprises a pitch computation section that obtains the mass pitch by analyzing the mass spectrum.

3. The mass spectrum processing apparatus according to claim 2, wherein the pitch computation section obtains the mass pitch by autocorrelation computation by using a portion of the mass spectrum that is within a chemical noise reference range set for the mass spectrum.

4. The mass spectrum processing apparatus according to claim 1, wherein the pattern generation section comprises a function computation section that computes an intensity function based on the plurality of actual fragments, a normalization unit that normalizes the plurality of actual fragments based on the intensity function, and a computation unit that generates the basic pattern based on the plurality of actual fragments obtained after normalization.

5. The mass spectrum processing apparatus according to claim 1, wherein the generation section comprises a correction unit that applies intensity correction to the basic pattern based on an intensity function obtained from the mass spectrum, thereby generating the plurality of pseudo fragments, and a connection unit that connects the plurality of pseudo fragments, thereby forming the pseudo chemical noise.

6. The mass spectrum processing apparatus according to claim 1, wherein the generation section comprises a connection unit that forms a connected body of a plurality of temporary fragments based on the basic pattern, and a correction unit that applies intensity correction to the plurality of temporary fragments based on an intensity function obtained from the mass spectrum, thereby generating, as the connected body of the plurality of pseudo fragments, the pseudo chemical noise.

7. The mass spectrum processing apparatus according to claim 1, further comprising a display processing section that displays two mass spectra, one mass spectrum obtained before the pseudo chemical noise is removed and one mass spectrum obtained after the pseudo chemical noise is removed.

8. The mass spectrum processing apparatus according to claim 7, wherein the display processing section further displays the pseudo chemical noise.

9. A mass spectrum processing method comprising the steps of:

extracting a basic pattern of chemical noise included in a mass spectrum, the basic pattern being a common waveform in a plurality of repeating units constituting the chemical noise, the basic pattern having a mass width of around 1 u;

generating pseudo chemical noise as a connected body of a plurality of pseudo fragments generated by applying intensity correction to the basic pattern; and removing the pseudo chemical noise from the mass spectrum, wherein an extraction section comprises:

a cut-out unit that cuts out a plurality of actual fragments, corresponding to the plurality of repeating units, from the mass spectrum according to a mass pitch which is the mass width, and a pattern generation section that generates the basic pattern based on the plurality of actual fragments.

10. A non-transitory storage medium storing a program for mass spectrum processing to be executed in an information processing device, the program comprising the functions of:

extracting a basic pattern of chemical noise included in a mass spectrum, the basic pattern being a common waveform in a plurality of repeating units constituting the chemical noise, the basic pattern having a mass width of around 1 u;

generating pseudo chemical noise as a connected body of a plurality of pseudo fragments generated by applying intensity correction to the basic pattern; and removing the pseudo chemical noise from the mass spectrum, wherein an extraction section comprises:

a cut-out unit that cuts out a plurality of actual fragments, corresponding to the plurality of repeating units, from the mass spectrum according to a mass pitch which is the mass width, and a pattern generation section that generates the basic pattern based on the plurality of actual fragments.

* * * * *